US008118319B2

(12) United States Patent
Hsieh

(10) Patent No.: US 8,118,319 B2
(45) Date of Patent: Feb. 21, 2012

(54) TWISTED STRUCTURE FOR A SKATEBOARD

(76) Inventor: Chao Hsieh, Taipei (TW)

( * ) Notice: Subject to any disclaimer, the term of this patent is extended or adjusted under 35 U.S.C. 154(b) by 84 days.

(21) Appl. No.: 12/834,016

(22) Filed: Jul. 12, 2010

(65) Prior Publication Data

US 2012/0007331 A1 Jan. 12, 2012

(51) Int. Cl.
*A63C 5/03* (2006.01)

(52) U.S. Cl. ..... 280/87.042; 280/87.041; 280/87.021

(58) Field of Classification Search ..... 280/87.042, 280/87.021, 87.041, 11.28, 11.25, 11.27, 280/87.01
See application file for complete search history.

(56) References Cited

U.S. PATENT DOCUMENTS 4,082,306 A * 4/1978 Sheldon ..... 280/87.042
5,865,446 A * 2/1999 Kobylenski et al. ..... 280/14.23
6,293,567 B1 * 9/2001 Menges ..... 280/14.21
7,338,056 B2 * 3/2008 Chen et al. ..... 280/87.042
7,600,768 B2 * 10/2009 Chen et al. ..... 280/87.042
7,654,554 B1 * 2/2010 Scaturro et al. ..... 280/610
8,047,556 B2 * 11/2011 Jang et al. ..... 280/87.042
2006/0217250 A1 * 9/2006 Pearson ..... 482/146
2007/0029749 A1 * 2/2007 Gregory et al. ..... 280/87.042
2009/0045598 A1 * 2/2009 Lee ..... 280/87.042
2009/0058028 A1 * 3/2009 Chen et al. ..... 280/87.042

* cited by examiner

*Primary Examiner* — J. Allen Shriver, II
*Assistant Examiner* — James Triggs

(57) ABSTRACT

A twisted structure for a skateboard includes a first board member having a first groove defined therein and extending therearound. A second board member is connected with the first board member. The second board member has a second groove defined therein and extending therearound. An elastic band is stretchably received in the first groove and the second groove. The elastic band encloses the first board member and the second board member for connecting the first board member with the second board member. Accordingly, the first board member is pivotally twisted related to the second board member by the elastic band.

5 Claims, 6 Drawing Sheets

TWISTED STRUCTURE FOR A SKATEBOARD

BACKGROUND OF THE INVENTION

1. Field of the Invention

The present invention relates to a twisted structure for a skateboard, particularly to the twisted structure having an elastic band enabling a first board member to pivotally twist relative to a second board member.

2. Description of Related Art

The extreme sports become more popular all over the world. People who are enthusiastic about the sports and are adventurous are all fond of the extreme sports. The players can also keep fit and improve the physical strength when doing the extreme sports. The extreme sports include skiing, skating, surfing, skydiving, skateboarding, rock climbing, etc. Especially, the snakeboarding is a kind of the skateboarding and has recently increased in popularity.

A conventional snakeboard usually comprises two footplates which are connected with each other. Two wheels are respectively attached to a bottom of the two footplates. The player of the snakeboarding stands with one foot in each footplate of a snakeboard. The snakeboard is propelled by shifting the user's body weight in different directions. Therefore, the player does not need to step on the ground to make the snakeboard moving.

However, the power and speed of the snakeboard is only controlled by continuously shifting the player's body weight and the feet positions. It is energy consuming and easy to cause the player's muscle aching. Moreover, the player may lose his balance to fall down from the snakeboard because the player frequently shifts his body weight and gets tired.

The present invention has arisen to mitigate and/or obviate the disadvantages of the conventional casing system.

SUMMARY OF THE INVENTION

Accordingly, the main object of the present invention is to provide an improved twisted structure for a skateboard which is able to save a user's energy and reduce the user's muscular aches.

To achieve the above objectives, the present invention provides a twisted structure for a skateboard comprising a first board member and a second board member connected to the first board member. The first board member comprises a first upper board and a first lower board overlappingly connected with each other. The first board member has a first pivot hole axially laterally defined therein and located between the first upper board and the first lower board. The first pivot hole has at least one first flange annularly formed on an inner periphery thereof. The first board member has a first groove defined therein and extending therearound. The first board member has a first through hole defined therein and extending through the first upper board and the first lower board. The first board member has two first curved recesses respectively defined in two opposite sides thereof.

The second board member comprises a second upper board and a second lower board overlappingly connected with each other. The second board member has a second pivot hole axially laterally defined therein and located between the second upper board and the second lower board. The second pivot hole has at least one second flange annularly formed on an inner periphery thereof. The second board member has a second groove defined therein and extending therearound. The second board member has a second through hole defined therein and extending through the second upper board and the second lower board. The second board member has two second curved recesses respectively defined in two opposite sides thereof.

A pivot shaft is pivotally connected with the first board member and the second board member. The pivot shaft has two ends and a connecting portion which is formed thereon and located between the two ends thereof. Each end of the pivot shaft has at least one annular flute defined in an outer periphery thereof. The two ends of the pivot shaft are respectively and pivotally received in the first pivot hole in the first board member and the second pivot hole in the second board member. The connecting portion of the pivot shaft is located between the first board member and the second board member. The at least one first flange and the at least one second flange are respectively engaged with the at least one annular flutes of the two ends of the pivot shaft, such that the first board member is able to be axially twisted or rotated relative to the second board member about the pivot shaft.

An elastic band is elastically received in the first groove and the second groove. The elastic band encloses the first board member and the second board member for connecting the first board member with the second board member. The elastic band is partially exposed at the two first curved recesses of the first board member and the two second recesses of the second board member. The elastic band provides a resilient force to limit a twisting movement of the first board member and the second board member for restoring the first board member and the second board member in an initial position.

When a user steps on the first board member and the second board member, the first board member and the second board member are axially twisted relative to the pivot shaft by the user's feet. The elastic band is stretched by the twisting movement of the first board member and the second board member. The elastic band provides the resilient force to restore the first board member and the second board member in an initial position, such that a skateboard is propelled to stably move, steer, and brake. Accordingly, the operation of the skateboard is energy-saved and reduces the user's muscular aches.

In accordance with a second aspect of the present invention, the first board member is formed by the first upper board and the first lower board. The first board member has a first groove defined therein and extending therearound. The first board member has a first through hole defined therein and extending through the first upper board and the first lower board. The first board member has two first curved recesses respectively defined in two opposite sides thereof.

The second board member is formed by the second upper board and the second lower board. The second board member has a second groove defined therein and extending therearound. The second board member has a second through hole defined therein and extending through the second upper board and the second lower board. The second board member has two second curved recesses respectively defined in two opposite sides thereof.

The elastic band is elastically received in the first groove and the second groove. The elastic band encloses the first board member and the second board member for connecting the first board member with the second board member. The elastic band is partially exposed at the two first curved recesses of the first board member and the two second recesses of the second board member.

Further benefits and advantages of the present invention will become apparent after a careful reading of the detailed description with appropriate reference to the accompanying drawings.

DETAILED DESCRIPTION OF THE INVENTION

Figure 1:
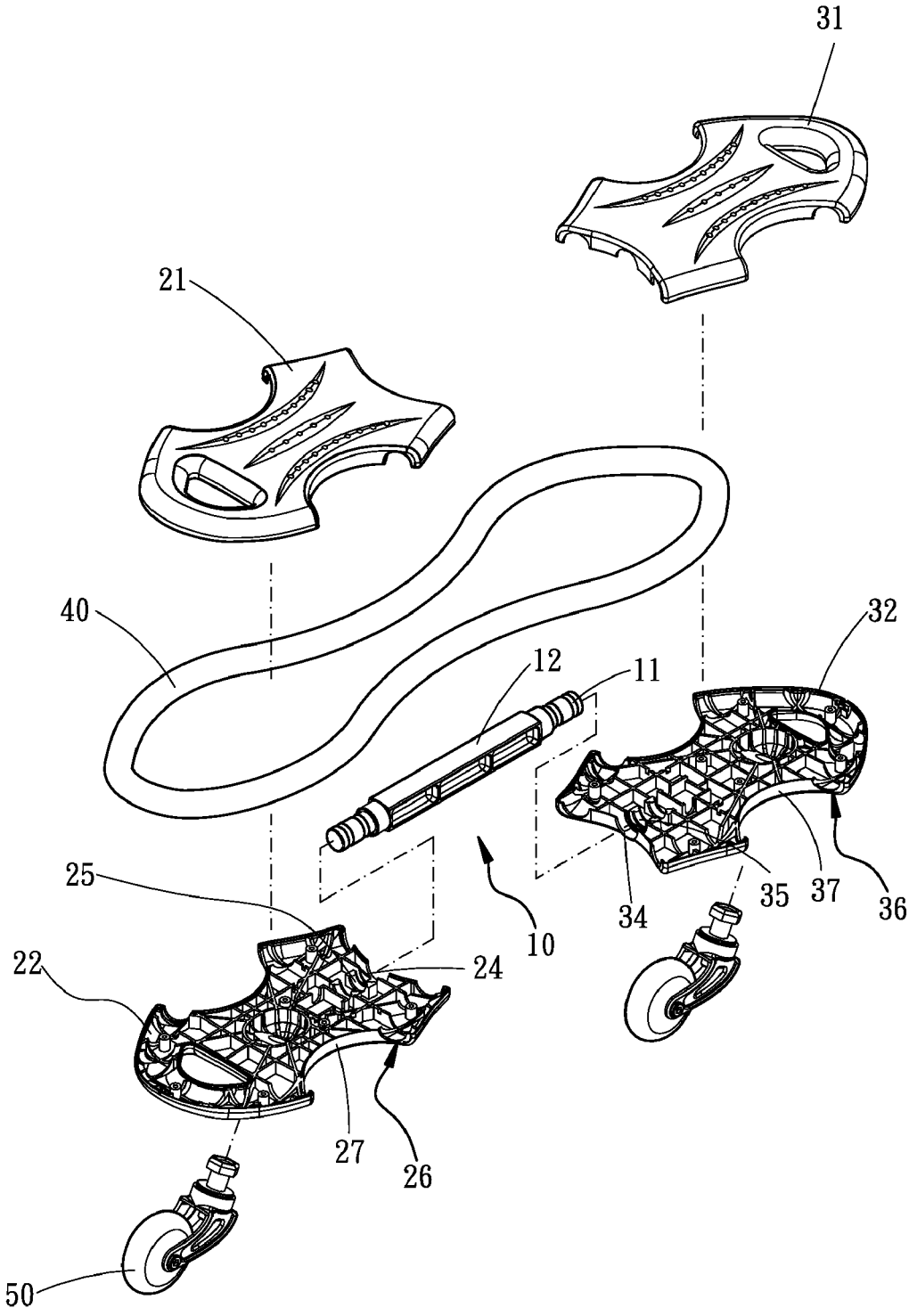
FIG. 1 is an exploded perspective view of a preferred embodiment of a twisted structure for a skateboard in accordance with the present invention.
Figure 2:
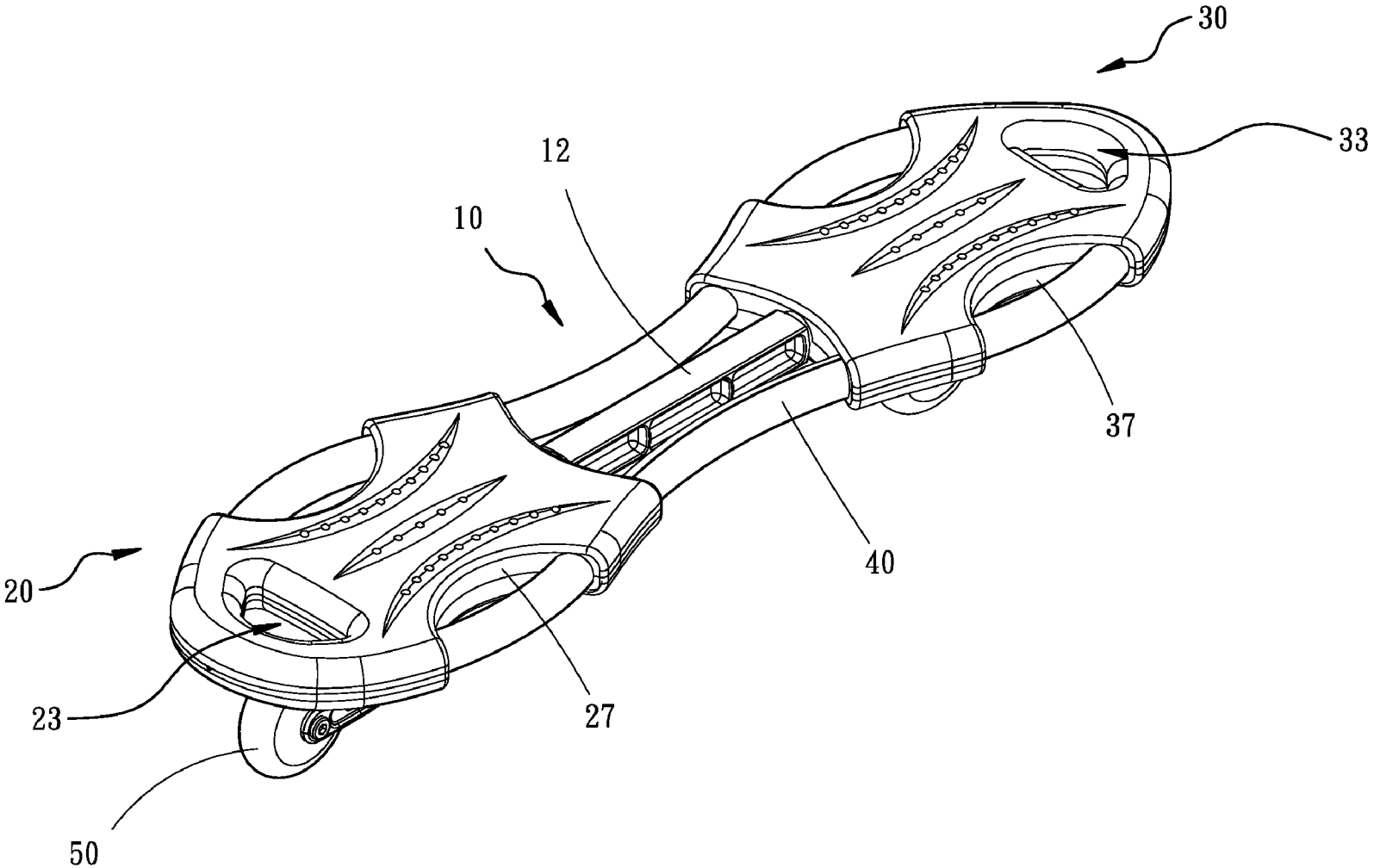
FIG. 2 is an assembled perspective view of the preferred embodiment of the twisted structure for a skateboard in accordance with the present invention.
Figure 3:
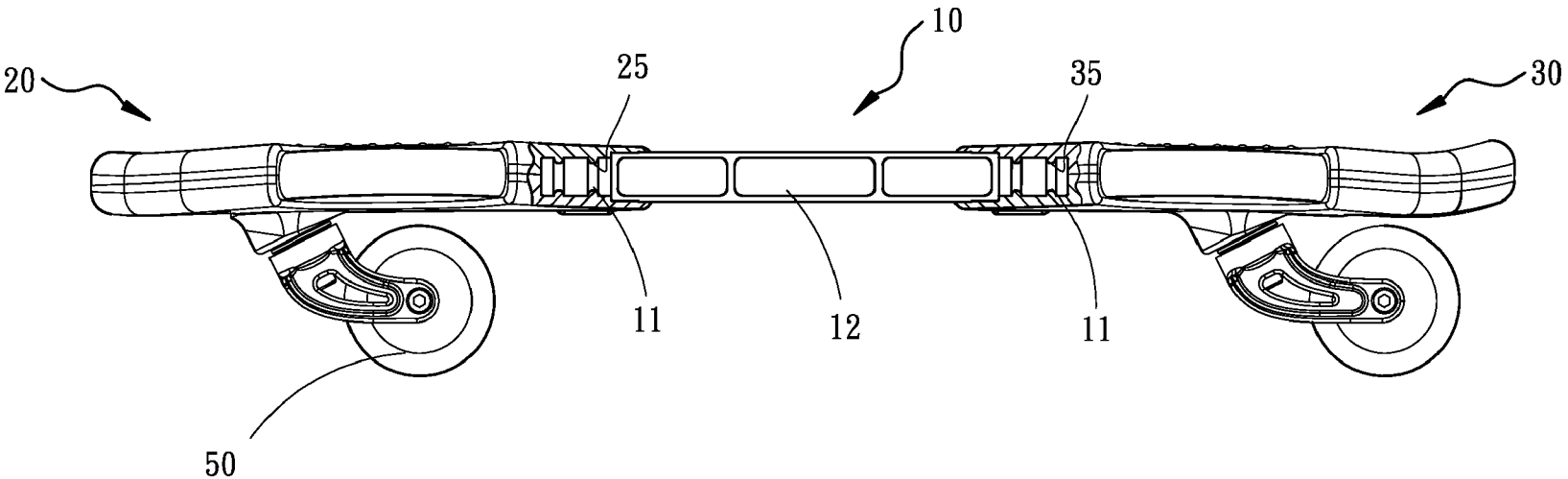
FIG. 3 is a partially cross-sectional side view of the preferred embodiment of the twisted structure for a skateboard in accordance with the present invention.
Figure 4:
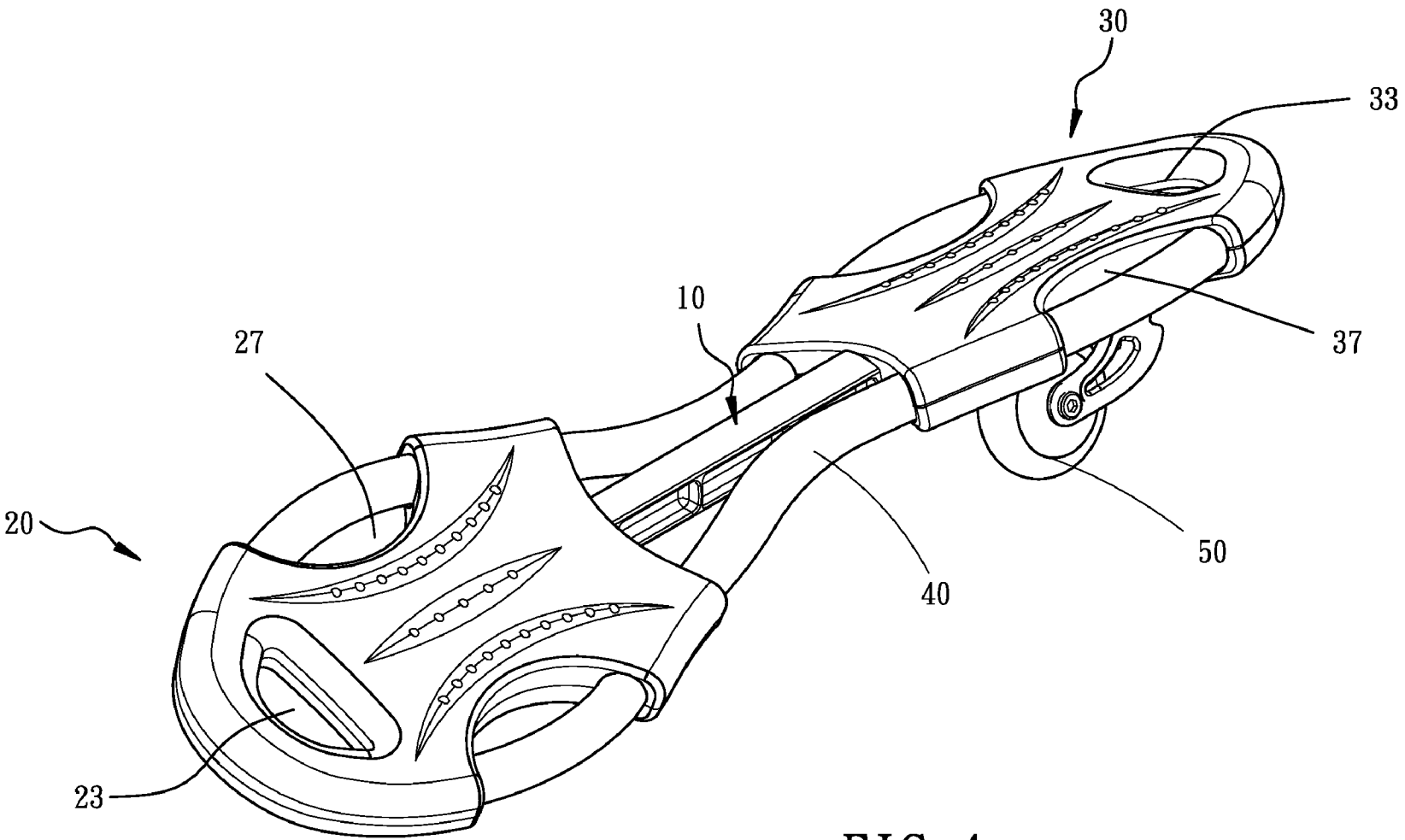
FIG. 4 is an operational perspective view of the preferred embodiment of the twisted structure for a skateboard in accordance with the present invention.

Referring to the drawings and initially to FIGS. 1-4, a twisted structure for a skateboard in accordance with the present invention comprises a first board member 20 and a second board member 30 coaxially connected to the first board member 20. The first board member 20 comprises a first upper board 21 and a first lower board 22 overlappingly connected with each other. The first board member 20 has a first pivot hole 24 axially laterally defined therein and located between the first upper board 21 and the first lower board 22. The first pivot hole 24 has two first flanges 25 spacedly and annularly formed on an inner periphery thereof. The first board member 20 has a first groove 26 defined therein and extending therearound. The first board member 20 has a first through hole 23 vertically defined therein and extending through the first upper board 21 and the first lower board 22. The first board member 20 has two first curved recesses 27 respectively and laterally defined in two opposite lateral sides thereof.

The second board member 30 comprises a second upper board 31 and a second lower board 32 overlappingly connected with each other. The second board member 30 has a second pivot hole 34 axially laterally defined therein and located between the second upper board 31 and the second lower board 32. The second pivot hole 34 has two second flanges 35 spacedly and annularly formed on an inner periphery thereof. The second board member 30 has a second groove 36 defined therein and extending therearound. The second board member 30 has a second through hole 33 vertically defined therein and extending through the second upper board 31 and the second lower board 32. The second board member 30 has two second curved recesses 37 respectively and laterally defined in two opposite lateral sides thereof.

A pivot shaft 10 is pivotally connected with the first board member 20 and the second board member 30. The pivot shaft 10 has two ends and a connecting portion 12 formed thereon. The connecting portion 12 is in a rectangular shape and is located between the two ends of the pivot shaft 10. Each end of the pivot shaft 10 has two annular flutes 11 spacedly defined in an outer periphery thereof. The two ends of the pivot shaft 10 are respectively and pivotally received in the first pivot hole 24 in the first board member 20 and the second pivot hole 34 in the second board member 30. The connecting portion 12 of the pivot shaft 10 is located between the first board member 20 and the second board member 30. The two first flanges 25 and the two second flanges 35 are respectively and correspondingly engaged with the four annular flutes 11 of the two ends of the pivot shaft 10 for preventing the first board member 20 and the second board member 30 from detaching. Accordingly, the first board member 20 is able to be axially twisted or rotated relative to the second board member 30 about the pivot shaft 10.

An elastic band 40 is stretchably received in the first groove 26 and the second groove 36. The elastic band 40 encloses around the first board member 20 and the second board member 30 for connecting the first board member 20 with the second board member 30. The elastic band 40 is exposed at the two first curved recesses 27 of the first board member 20 and the two second recesses 37 of the second board member 30. The elastic band 40 is exposed between the first board member 20 and the second board member 30. The elastic band 40 provides a resilient force to limit a twisting movement of the first board member 20 and the second board member 30 for restoring the first board member 20 and the second board member 30 in an initial position. The elastic band 40 is made of a light emitting material which contains phosphors.

Two wheels 50 are respectively mounted to a bottom of the first lower board 22 and a bottom of the second lower board 32, such that the two wheels 50 enable the skateboard to move.

When a user steps on the first board member 20 and the second board member 30, the first board member 20 and the second board member 30 are axially twisted or rotated relative to the pivot shaft 10 by shifting the user's body weight. The elastic band 40 is stretched by the twisting movement of the first board member 20 and the second board member 30. The elastic band 40 provides the resilient force to restore the first board member 20 and the second board member 30 in an initial position. The movement of the first board member 20 and the second board member 30 enables the two wheels 50 to roll, such that the skateboard is propelled to stably move forward or brake.

Figure 5:
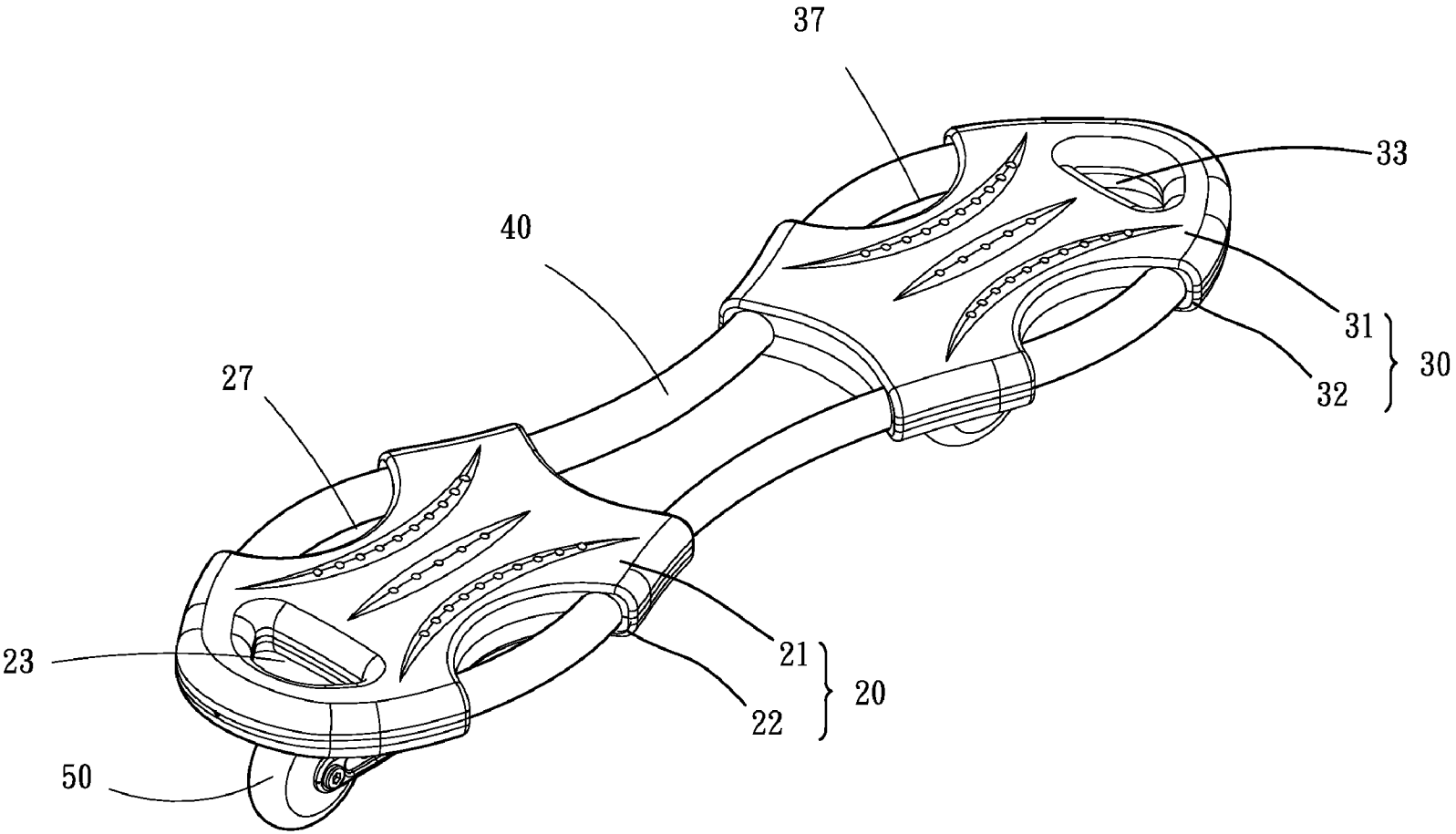
FIG. 5 is an assembled perspective view of a second embodiment of the twisted structure for a skateboard in accordance with the present invention.
Figure 6:
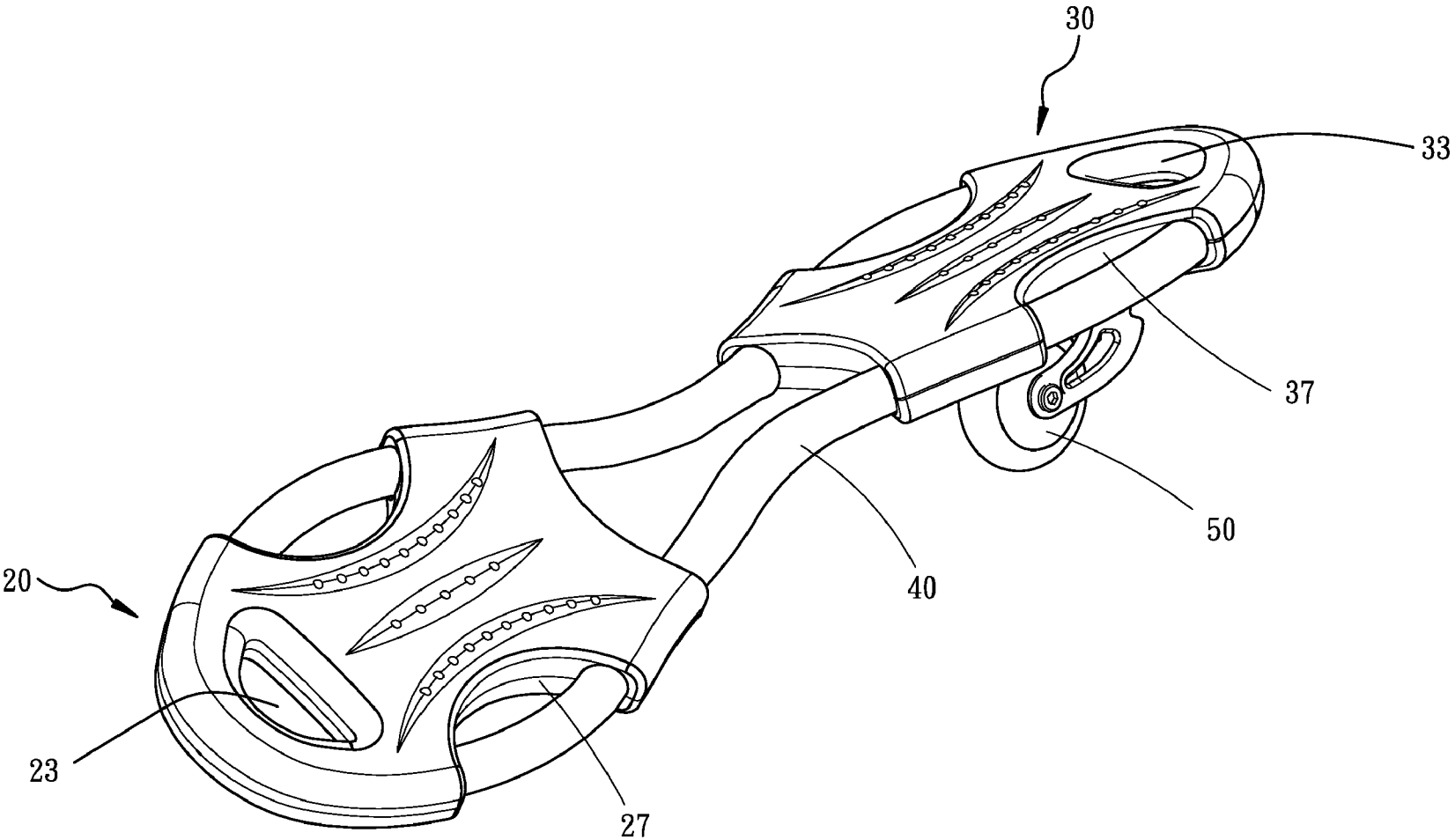
FIG. 6 is an operational perspective view of the second embodiment of the twisted structure for a skateboard in accordance with the present invention.

With reference to FIGS. 5-6, these show a second embodiment of the twisted structure for a skateboard in accordance with the present invention. The elements and effects of the second embodiment which are the same with the preferred embodiment are not described, only the differences are described. In this embodiment, the first board member 20 is formed by the first upper board 21 and the first lower board 22. The first board member 20 has a first groove 26 (shown in FIG. 1) defined therein and extending therearound. The first board member 20 has a first through hole 23 defined therein and vertically extending through the first upper board 21 and the first lower board 22. The first board member 20 has two first curved recesses 27 respectively defined in two opposite sides thereof.

The second board member 30 is formed by the second upper board 31 and the second lower board 32. The second board member 30 has a second groove 36 (shown in FIG. 1) defined therein and extending therearound. The second board member 30 has a second through hole 33 defined therein and vertically extending through the second upper board 31 and the second lower board 32. The second board member 30 has two second curved recesses 37 respectively defined in two opposite sides thereof.

The elastic band 40 is elastically received in the first groove 26 and the second groove 36. The elastic band 40 encloses around the first board member 20 and the second board member 30, such that the first board member 20 is spacedly connected with the second board member 30. The elastic band 40 is partially exposed at the two first curved recesses 27 in the first board member 20 and the two second curved recesses 37 in the second board member 30.

Accordingly, there are several advantages to the twisted structure for a skateboard in accordance with the present invention. Firstly, during assembling, the first board member 20 is assembled from the first upper board 21 and the first lower board 22, and the second board member 30 is assembled from the second upper board 31 and the second lower board 32. The pivot shaft 10 and the elastic band 40 are easily placed into the first board member 20 and the second board member 30. It increases the efficiency of the assembling process. Secondly, when the elastic band 40 is illuminated by the visible light and the electromagnetic wave, the phosphors of the elastic band 40 are actuated to continuously emit light. Therefore, the emitted light of the elastic band 40 provides a warning effect when the skateboard is used in the dark or dusky places. Thirdly, the user is easily grasped the skateboard through the first through hole 23, the second through hole 33, the two first curved recesses 27, and the two second curved recesses 37. Or the user can attach a rope or a chain through the first through hole 23, the second through hole 33, the two first curved recesses 27, and the two second curved recesses 37, such that the user is able to conveniently carry the skateboard. Furthermore, due to the resilient force provided by the elastic band 40, the operation of the skateboard is energy-saved and reduces the user's muscular aches.

Although the invention has been explained in relation to its preferred embodiment, it is to be understood that many other possible modifications and variations can be made without departing from the spirit and scope of the invention as hereinafter claimed.

What is claimed is:

1. A twisted structure for a skateboard comprising:

a first board member having a first groove defined therein and extending therearound;

a second board member connected with the first board member, the second board member having a second groove defined therein and extending therearound; and an elastic band received in the first groove and the second groove, the elastic band enclosing the first board member and the second board member for connecting the first board member with the second board member;

wherein the first board member is elastically twisted relative to the second board member by the elastic band.

2. The twisted structure for a skateboard as claimed in claim 1 further comprising a pivot shaft pivotally connected with the first board member and the second board member, the pivot shaft having two ends and a connecting portion formed thereon and located between the two ends thereof, each end of the pivot shaft having at least one annular flute defined in an outer periphery thereof;

the first board member having a first pivot hole defined therein, the first pivot hole having at least one first flange annularly formed on an inner periphery thereof for corresponding to the at least one annular flute of one end of the pivot shaft;

the second board member having a second pivot hole defined therein, the second pivot hole having at least one second flange annularly formed on an inner periphery thereof for corresponding to the at least one annular flute of the other end of the pivot shaft;

wherein the two ends of the pivot shaft are respectively and pivotally received in the first pivot hole in the first board member and the second pivot hole in the second board member, the connecting portion of the pivot shaft located between the first board member and the second board member, the at least one first flange and the at least one second flange respectively engaging with the at least one annular flutes of the two ends of the pivot shaft.

3. The twisted structure for a skateboard as claimed in claim 1, wherein the first board member comprises a first upper board and a first lower board overlappingly connected with each other, the second board member comprising a second upper board and a second lower board overlappingly connected with each other.

4. The twisted structure for a skateboard as claimed in claim 3, wherein the first board member has a first through hole defined therein and extending through the first upper board and the first lower board;

the second board member having a second through hole defined therein and extending through the second upper board and the second lower board.

5. The twisted structure for a skateboard as claimed in claim 1, wherein the first board member has two first curved recesses respectively defined in two opposite sides thereof, the second board member having two second curved recesses respectively defined in two opposite sides thereof, such that the elastic band received in the first groove and the second groove is partially exposed at the four first and second recesses.

* * * * *